United States Patent [19]

Osborne

[11] Patent Number: 4,610,632

[45] Date of Patent: Sep. 9, 1986

[54] ELECTRIC BOAT MOTOR

[76] Inventor: Edward W. Osborne, P.O. Box 134, Walls, Miss. 38680

[21] Appl. No.: 610,123

[22] Filed: May 14, 1984

[51] Int. Cl.[4] ..... B60C 11/02

[52] U.S. Cl. ..... 440/6; 114/144 E

[58] Field of Search ..... 440/6-7, 440/58-59; 114/144 R, 144 E, 153; 200/86.5, 153 C, 5 A, 1 R; 318/257, 291, 293, 287, 548, 551; 310/198

[56] References Cited

U.S. PATENT DOCUMENTS

| | | | |
|---|---|---|---|
| 2,498,223 | 2/1950 | Rommel | 114/144 E |
| 2,877,733 | 3/1959 | Harris | 440/7 |
| 3,218,531 | 11/1965 | Smith et al. | 318/548 |
| 3,598,947 | 8/1971 | Osborn | 440/7 |
| 3,697,846 | 10/1972 | Mueller | 318/548 |
| 4,143,436 | 3/1979 | Jones | 440/7 |
| 4,299,182 | 11/1981 | Tanaka | 318/551 |

*Primary Examiner*—Trygve M. Blix
*Assistant Examiner*—Jesûs D. Sotelo
*Attorney, Agent, or Firm*—Nixon & Vanderhye

[57] ABSTRACT

An improved electric boat motor of the type including a propelling motor, a support shaft, and a coupling member for rotatably coupling the support shaft to the boat. The improvement includes an electric steering motor for continuously rotating the support shaft, an electrical energy transfer mechanism for allowing electrical energy to be continuously provided to the propelling motor as the support is continuously rotated, and a switch mechanism for controlling the passage of electrical energy to the steering motor, transfer mechanism and propelling motor.

16 Claims, 8 Drawing Figures

ELECTRIC BOAT MOTOR

BACKGROUND OF THE INVENTION

1. Field of the Invention

The present invention relates, in general, to electric boat motors for use with a source of electrical energy to propel a boat on a body of water.

2. Description of the Prior Art

Heretofore, various electric boat motors and the like have been developed. See, for example, Moser, U.S. Pat. No. 2,804,838; Harris, U.S. Pat. No. 2,877,733; Osborn, U.S. Pat. No. 3,598,947; Harris, U.S. Pat. No. 3,602,181; Peterson, U.S. Pat. No. 3,807,345; Childre, U.S. Pat. No. 3,995,579; Harris, U.S. Pat. No. 4,037,556; and Russell, U.S. Pat. No. 4,051,802. None of the above patents disclose or suggest the present invention.

SUMMARY OF THE INVENTION

The present invention is directed toward improving the steering and operation control of electric trolling motors for use by fishermen and boating enthusiasts. The concept of the present invention is to provide means for allowing an electric trolling motor to be steered and controlled by way of electrical switches mounted remote from the propulsion unit of the electric trolling motor and which allows the propulsion unit to be rotated in a continuous manner in any direction.

The improvement of the present invention comprises, in general, an electric steering means for selectively causing the support shaft means of an electric boat motor to rotate in a continuous manner; electrical energy transfer means for allowing electrical energy to be continuously provided to the propelling motor means of the electric boat motor as the support shaft rotates in a continuous manner, electrical pathway means for providing an electrical pathway between a source of electrical energy and the steering means and transfer means, and between the transfer means and the propelling motor means; and switch means for controlling the passage of electrical energy through the pathway means.

DESCRIPTION OF THE PREFERRED EMBODIMENT

Figure 1:
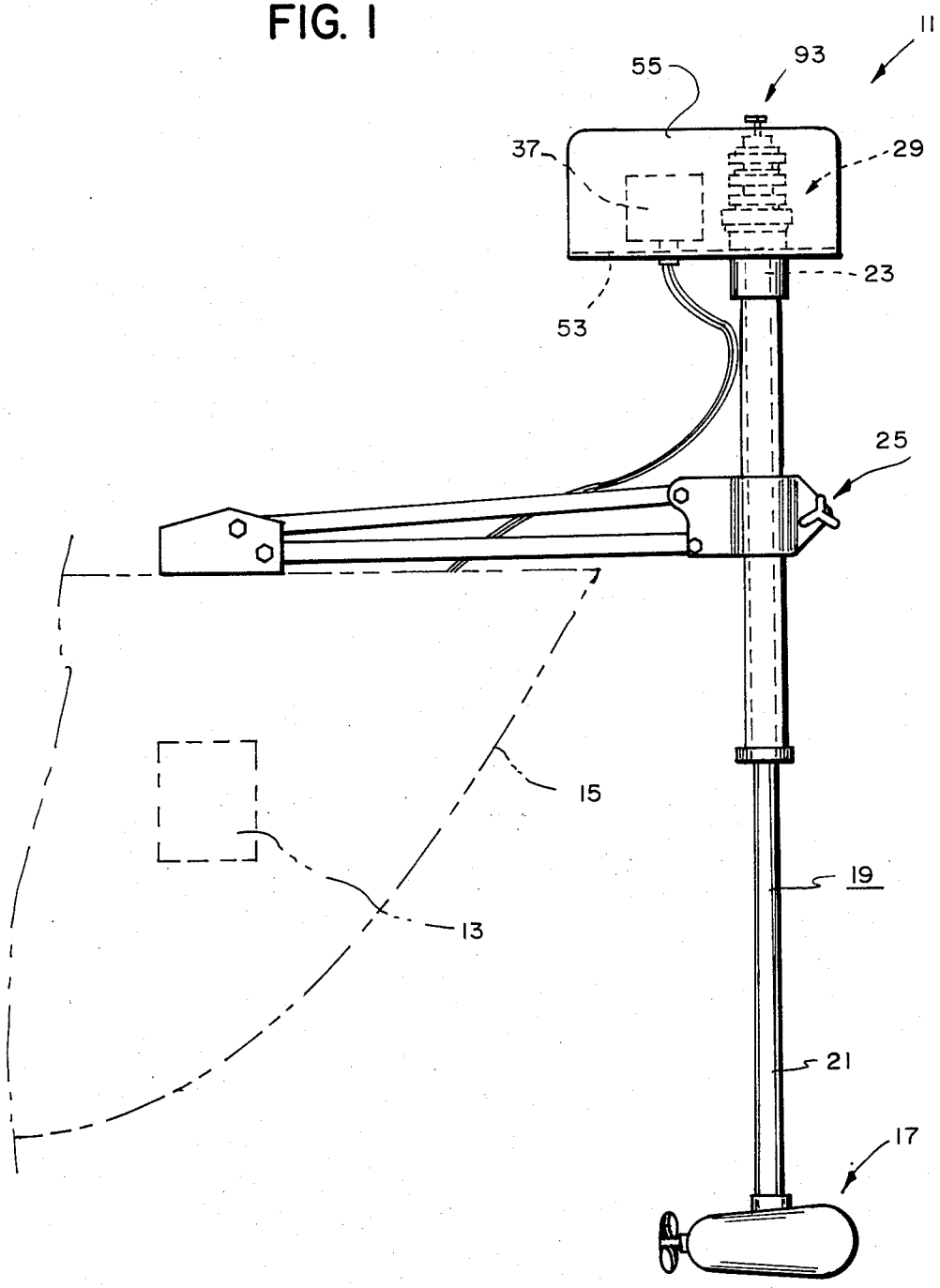
FIG. 1 is a side elevational view of a portion of the boat motor of the present invention with a boat shown in broken lines.

The improved electric boat motor 11 of the present invention is for use with a source of electrical energy such as a typical battery 13 to propel a boat 15 on a body of water (see, in general, FIG. 1). The boat motor 11 includes an electric propelling motor means 17 for providing a propulsive force, a support shaft means 19 having a lower end 21 fixedly attached to the propelling motor means 17 and having an upper end 23, and a coupling or mounting means 25 for rotatably attaching the support shaft means 19 to the boat 15 and for positioning the propelling motor means 17 with respect to the body of water to allow rotation of the support shaft means 19 to effect the navigation of the boat 15 on the body of water. The specific construction of the propelling motor means 17, support shaft means 19 and coupling means 25 may vary as will now be apparent to those skilled in the art. For a more detailed description of typical constructions of such propelling motor means, support shaft means and coupling means, reference may be made to the above cited Harris patents, U.S. Pat. No. 2,877,733 and U.S. Pat. No. 3,602,181.

The improvement of the present invention comprises, in general, an electric steering means 27 for selectively causing the support shaft means 19 to rotate in a continuous manner; electrical energy transfer means 29 for allowing electrical energy to be continuously provided to the propelling motor means 17 as the support shaft means 19 rotates in a continuous manner; electrical pathway means 31 for providing an electrical pathway between the battery 13 or other source of electrical energy and the steering means 27 and the transfer means 29 and between the transfer means 29 and the propelling motor means 17; and switch means for controlling the passage of electrical energy through the pathway means 31.

The boat 15 preferably has a deck 15' (see FIG. 6) and the majority of the portion of the pathway means 31 between the battery 13 or other source of electrical energy and the steering means 27 and the transfer means 29 is preferably located beneath the deck 15'. Such arrangement avoids the common practice of running the electrical wires from the propulsion unit to the steering and operation control switches over the deck of the boat, spanning normal areas of movement throughout the boat and creating hazards for persons standing or moving about in the boat.

Figure 2:
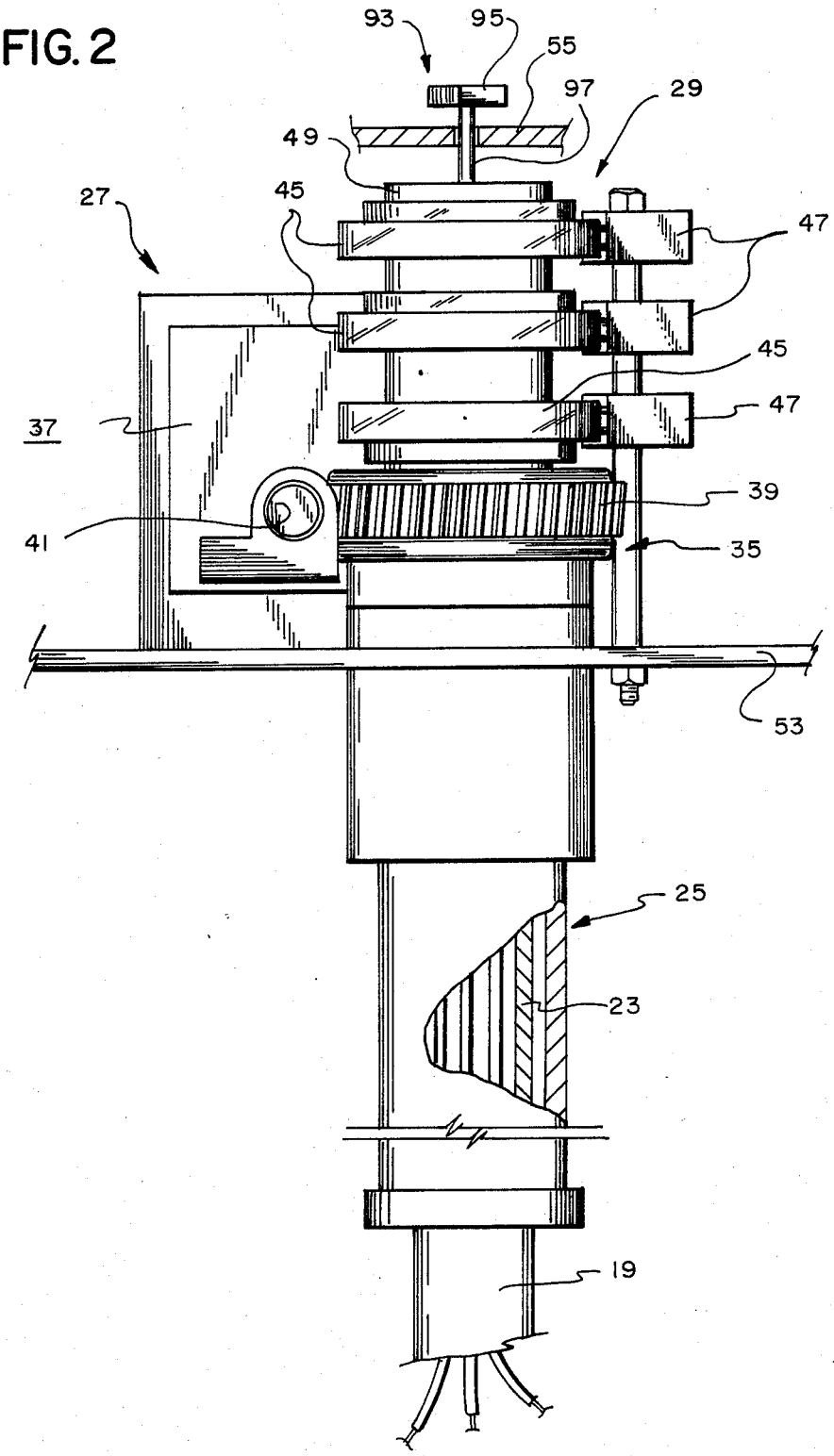
FIG. 2 is an enlarged view of a portion thereof with certain portions broken away and removed for clarity.
Figure 3:
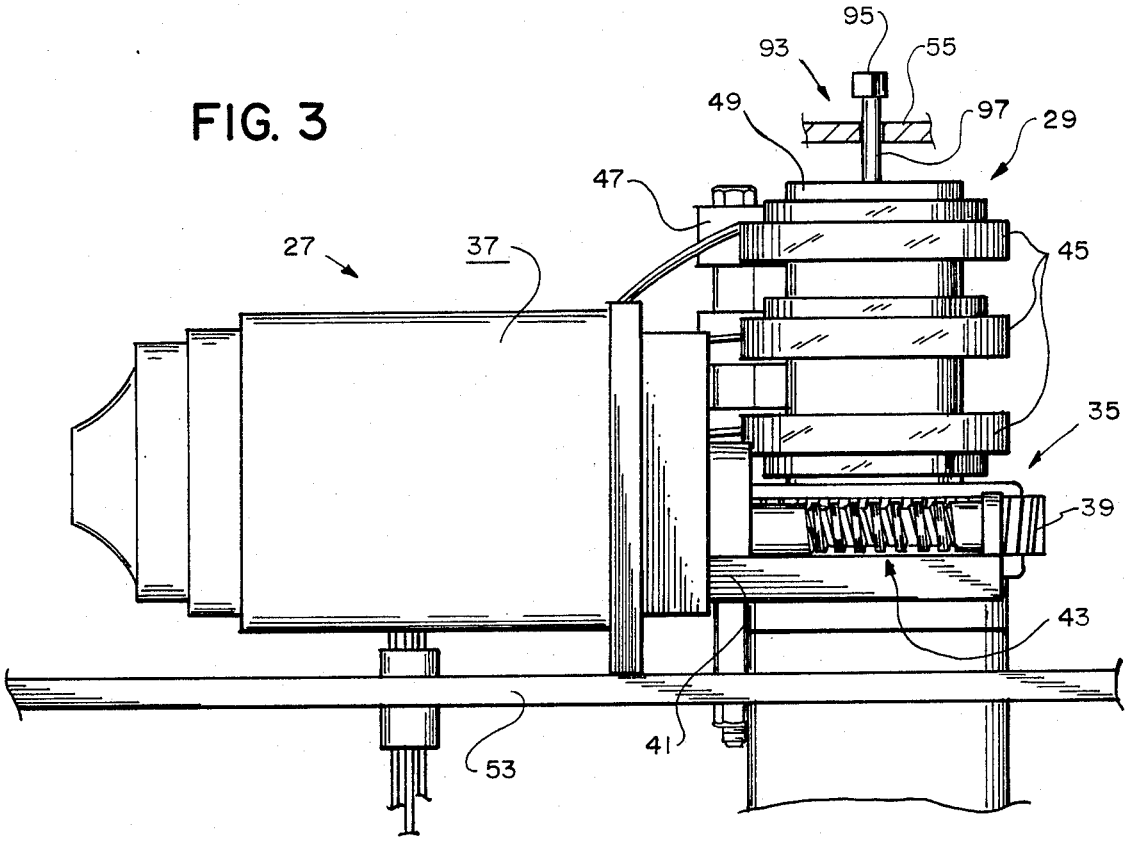
FIG. 3 is a left side view of a portion of FIG. 2.
Figure 4:
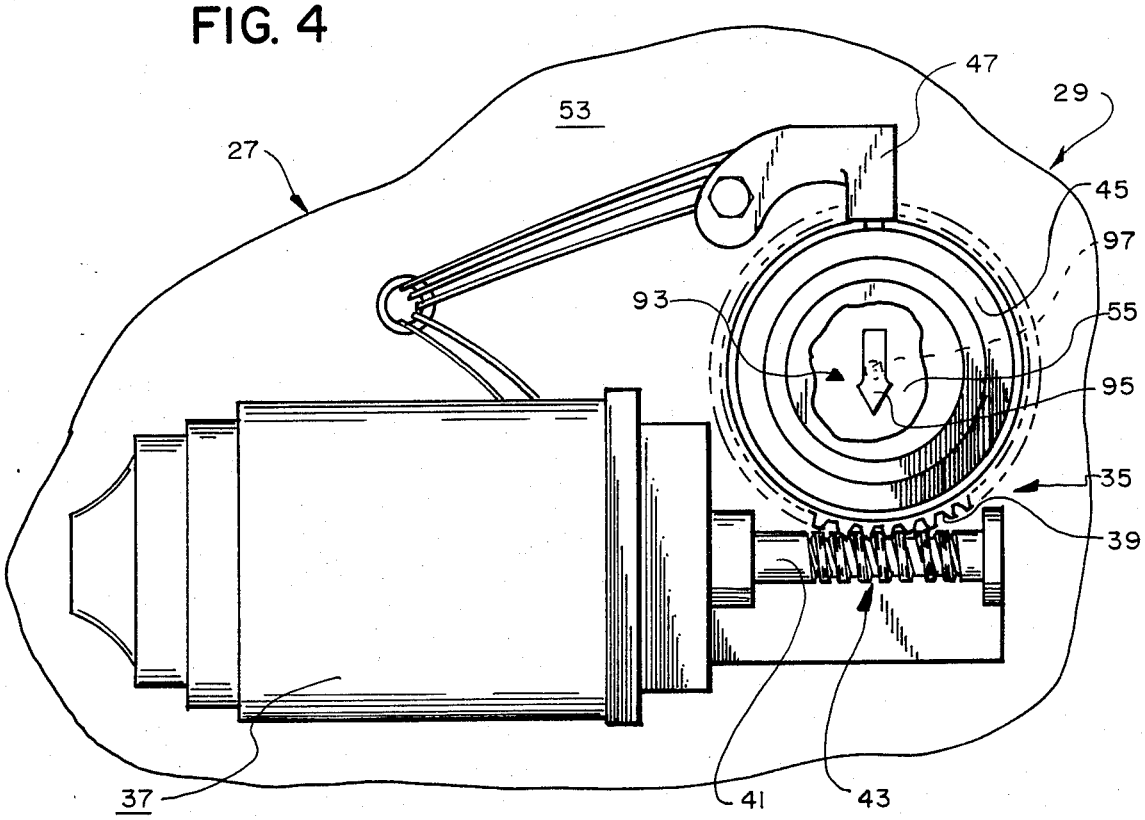
FIG. 4 is a top plan view of FIG. 3.

The steering means 27 preferably includes a drivable member 35 fixedly attached relative to the upper end 23 of the support shaft means 19 and preferably includes an electric drive motor 37 for selectively causing the drivable member 35 to continuously rotate to thereby cause the support shaft means 19 to continuously rotate (see, in general, FIGS. 2–4). The drivable member 35 may consist of a circular gear 39 fixedly mounted relative to the upper end 23 of the support shaft means 19 and positioned substantially transverse to the longitudinal axis of the support shaft means 19. The electric drive motor 37 may be of any typical construction having a rotatably driven drive shaft 41. A typical drive gear 43 is preferably provided on the drive shaft 41 for rotation therewith and for engaging the circular gear 39 of the drivable member 35 whereby rotation of the drive shaft 41 of the electric drive motor 37 will cause the circular gear 39 to rotate and whereby rotation of the drive shaft 41 in a first direction will cause the support shaft means 19 to rotate in a first direction (e.g., clockwise) and rotation of the drive shaft 41 in a second direction will cause the support shaft means 19 to rotate in a second direction (e.g., counterclockwise).

The transfer means 29 may include an electrically conductive ring member fixedly mounted relative to the upper end 23 of the support shaft means 19 for rotation therewith and an electrically conductive brush means mounted relative to the upper end 23 of the support shaft means 19 for making continuous electrical contact with the ring means regardless of the amount of rotation of the support shaft means 19. Preferably, the ring means includes a plurality of electrically conductive ring members 45 fixedly mounted relative to the upper end 23 of the support shaft means 19 for rotation therewith. Likewise, the brush means preferably include a plurality of brush members 47 mounted relative to the upper end 23 of the support shaft means 19, each of the brush members 47 positioned so as to make continuous electrical contact with respective ones of the ring members 45. The brush members 47 may be of any typical construction now apparent to those skilled in the art. Thus, each brush member 47 may include an electrically conductive member for making electrical contact with a respective ring member 45 and may include a spring or other means for urging the electrically conductive member against the respective ring member 45; an electrically conductive wire or the like of the pathway means 31 is attached to each electrically conductive member to complete the electric circuit through the transfer means 29.

Figure 8:
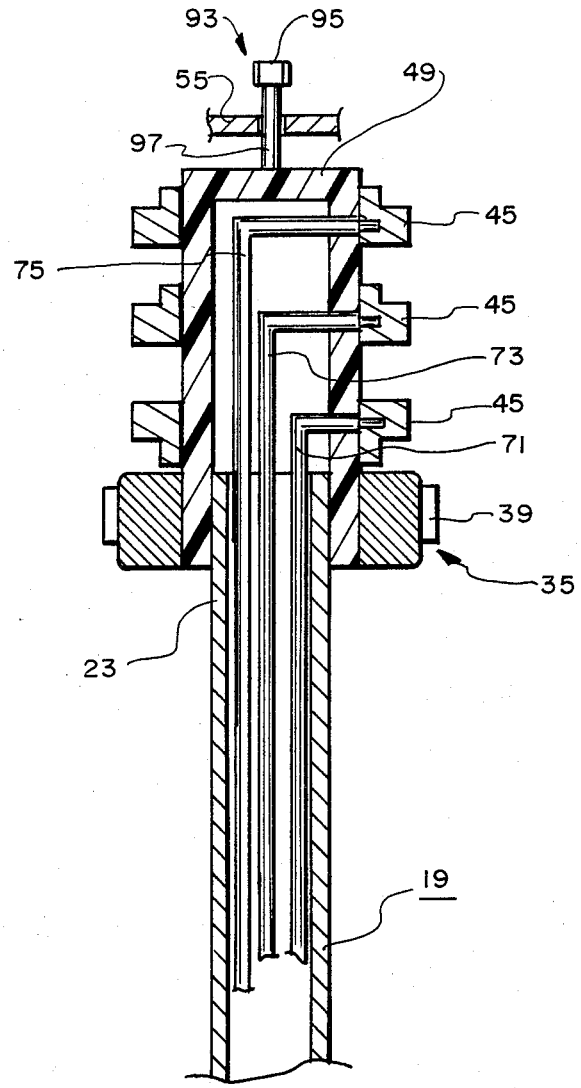
FIG. 8 is a sectional view of a portion of the boat motor of the present invention.

The specific construction of the steering means 27 and transfer means 29 may vary as will now be apparent to those skilled in the art. Thus, for example, the circular gear 39, ring members 45 and brush members 47 may be fixedly mounted on a head member 49 that is in turn fixedly mounted on the upper end 23 of the support shaft means 19 in any manner apparent to those skilled in the art (see, in general, FIG. 8). The ring members 45 are preferably attached to the head member 49 in a manner so as to be electrically insulated from one another and from the support shaft means 19 whereby electrical energy will be transferred by the ring members 45 only by way of the brush members 47 and the electrical pathway means 31 in a manner hereinafter to be described. Thus, for example, the head member 49 may be constructed of an electrical insulative material such as plastic or the like.

The electric drive motor 37 and brush members 47 are preferably nonrotatably mounted relative to the upper end 23 of the support shaft means 19 in any manner now apparent to those skilled in the art. Thus, for example, a platelike base member 53 may be nonrotatably mounted relative to the upper end 23 of the support shaft means 19 in any manner apparent to those skilled in the art such as by being fixedly attached to the coupling means 25 or the like (see, in general, FIGS. 1–4). The electric drive motor 37 and brush members 47 can then be fixedly attached to the base member 53 in any manner apparent to those skilled in the art such as by way of bolt means or the like. The base member 53 may also provide support for a housing 55 or the like for covering the drive motor 37, circular gear 39, drive gear 43, ring member 45, brush member 47 and associated structure (see, FIG. 1).

The specific construction of the electrical pathway means 31 may vary as will now be apparent to those skilled in the art. Thus, the electrical pathway means 31 may be as depicted in the electrical schematic of FIG. 5 and as more fully described here below with respect to the switch means.

The drive motor 37 is preferably of the reversible type well known to those skilled in the art. The switch means preferably includes a normally open first switch member 57 for selectively causing the drive motor 37 to rotate in a first direction (e.g., clockwise) and preferably includes a normally open second switch member 59 for selectively causing the drive motor to rotate in a second direction (e.g., counterclockwise). The first and second switch members 57, 59 are preferably operatively coupled to one another to, in effect, operate as a normally open three position, double throw switch unit whereby when one of the switch members 57, 59 is "closed", the other one is "grounded" as clearly shown in FIG. 5. The switch means also preferably includes a normally open third switch member 61 for selectively energizing the propelling motor means 17. The switch means also preferably includes a fourth switch member 63 for selectively controlling the speed of the propelling motor means 17. Thus, for example, propelling motor means 17 may include a typical variable speed motor having a high speed input 65, a low speed input 67 and a ground input 69. The electrical pathway means 31 may merely include a first electrical conductive wire 71 extending from one of the ring members 45 to the high speed input 65, another electrically conductive wire 73 extending from another ring member 45 to the low speed input 67, and another electrically conductive wire 75 extending from another ring member 45 to the ground input 69. Thus, the fourth switch means 63 may consist simply of a switch for selecting between the high and low speed inputs 65, 67 as clearly shown in FIG. 5.

The first, second and third switch members 57, 59, 61 are preferably associated with one another to provide the navigator of the boat 15 with a foot-controlled unit 62 for allowing the basic operation of the boat motor 11 to be controlled solely and easily by the navigator's foot in a manner which will hereinafter become apparent. Additionally, the first, second, and third switch members 57, 59, 61 are preferably positioned so as to allow the third switch member 61 and either of the first or second switch members 57, 59 to be closed simultaneously. More specifically, the first, second and third switch members 57, 59, 61 are preferably positioned on the deck 15' of the boat 15 in an arrangement relative to one another so as to allow the navigator of the boat 15 to close the third switch member 61 and either of the first or second switch members 57, 59 with one foot F as clearly shown in FIG. 6. Thus, the actuator for the first and second switch members 57, 59 include CW and CCW buttons which are preferably positioned in a spaced apart, side by side relation with the third switch member 61 substantially centered between the CW and CCW actuates for the first and second switch members 57, 59 and positioned substantially directly therebehind.

Figure 7:
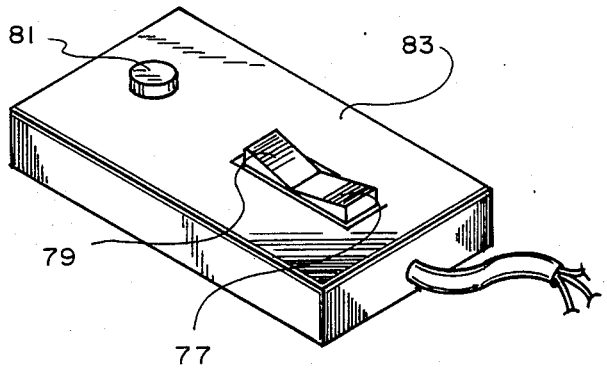
FIG. 7 is a perspective view showing certain controls of the boat motor of the present invention.

The switch means also preferably includes a normally open fifth switch member 77 for selectively energizing the propelling motor means 17. The third and fifth switch members 61, 77 are preferably electrically coupled parallel to one another to allow either one to be utilized to energize the propelling motor means 17 for reasons which will hereinafter become apparent. The switch means also preferably includes a normally open sixth switch member 79 for selectively causing the drive motor 37 to rotate in the first direction and a normally open seventh switch member 81 for selectively causing the drive motor 37 to rotate in the second direction. The sixth and seventh switch members 79, 81 are preferably operatively coupled to one another to, in effect, operate as a normally open three position, double throw switch unit whereby when one of the switch members 79, 81 is "closed", the other one is "grounded" as clearly shown in FIG. 5. The first and sixth switch members 57, 79 are preferably electrically coupled parallel to one another to allow either one to be utilized to energize the drive motor 37 in the first direction. Likewise, the second and seventh switch members 59, 81 are preferably electrically coupled parallel to one another to allow either one to be utilized to energize the drive motor 37 in the second direction. The fifth, sixth and seventh switch members 77, 79, 81 are preferably associated with one another to provide the navigator of the boat 15 with a hand-controlled unit 82 for allowing the basic operation of the boat motor 11 to be controlled solely and easily by the navigator's hand in a manner which will hereinafter become apparent. More specifically, the fifth, sixth and seventh switch members 77, 79, 81 are preferably positioned within a box member 83 to allow the switch members 77, 79, 81 to be positioned anywhere desired within the boat 15 (se FIG. 7). Thus, the box member 83 can be fastened to the navigator's arm with a strap or the like (not shown), attached to the arm of a chair or the like within the boat 15, etc.

A selector switch means 85 may also be provided within the electrical pathway means 31 for allowing either the first and second switch members 57, 59 or the sixth and seventh switch members 79, 81 to be electrically coupled to the drive motor 37. The selector switch means 85 may consist simply of a typical double pole, double throw switch member 87 positioned within the electrical pathway means 31 between the drive motor 37 and the switch members 57, 59, 77, 79 as clearly shown in FIG. 5.

Figure 5:
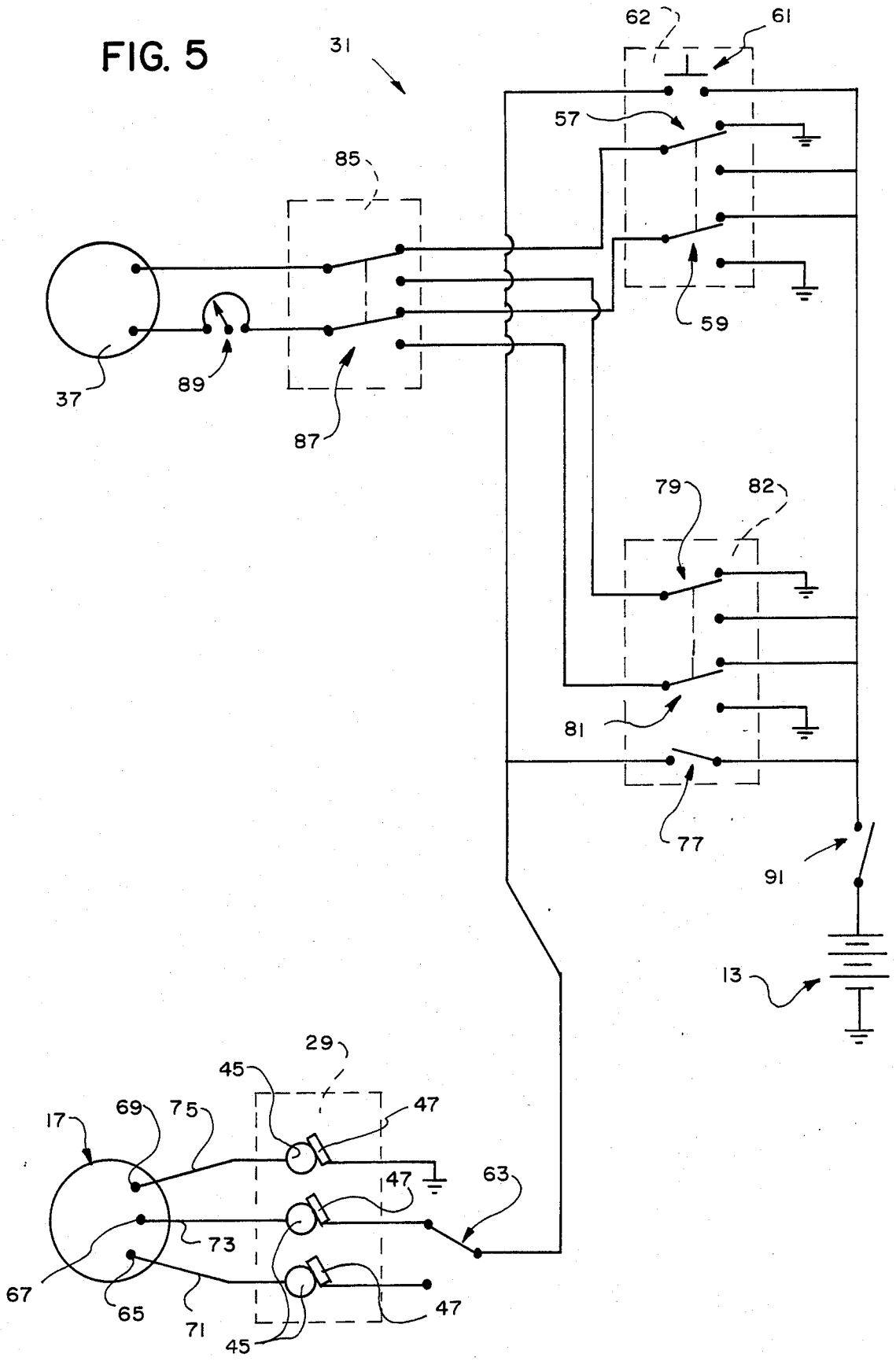
FIG. 5 is an electrical schematic of the boat motor of the present invention.

A rheostat means 89 is preferably provided in the electrical pathway means 31 as shown in FIG. 5 for allowing the speed of the drive motor 37 to be controlled in typical manner.

A main switch means 91 may also be provided in the electrical pathway means 31 for providing a master on-off switch for the boat motor 11.

Figure 6:
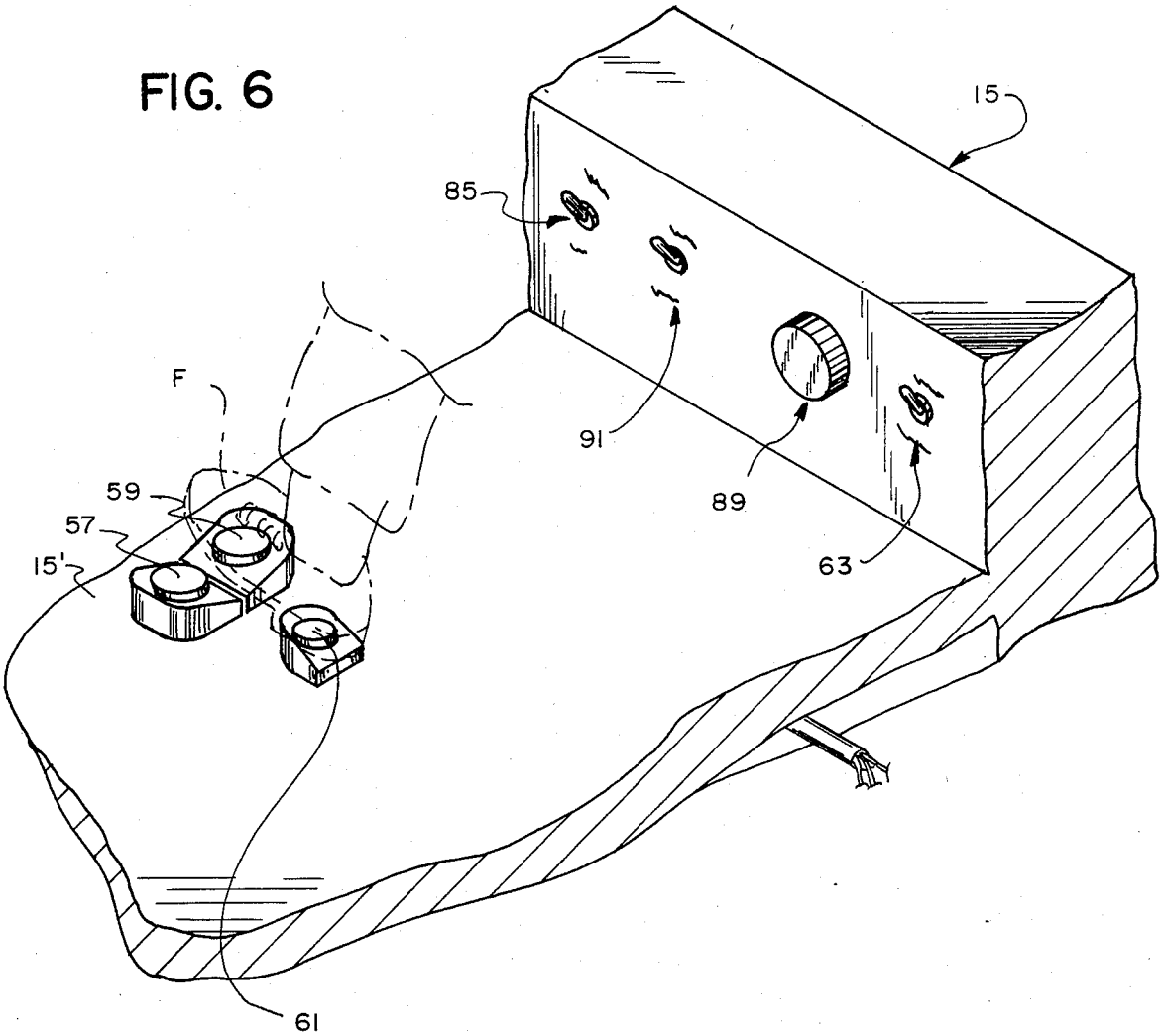
FIG. 6 is a perspective view showing certain controls of the boat motor of the present invention mounted on a boat.

The fourth switch member 63, selector switch means 85, rheostat means 89 and main switch means 91 may be located on the side of the boat 15 adjacent the foot control switch unit as shown in FIG. 6.

The boat motor 11 preferably includes indicia means 93 for indicating the direction which the propelling motor means 17 is pointed. The indicia means 93 may consist simply of an arrow-shaped member 95 that is rotatably coupled to the support shaft means 19. More specifically, a shaft 97 is preferably fixedly attached to the upper end of the head member 49 and extends through the cover 55 (see FIGS. 1–4 and 9). The arrow-shaped member 95 is in turn fixedly attached to the shaft 97 above the cover 55 whereby the arrow-shaped member 95 will be rotated whenever the steering means means 27 causes the support shaft means 19 and propelling motor means 17 to rotate. Thus, the arrow-shaped member 95 will at all times point in the direction that the propelling motor means 17 would at that moment propel the boat 15.

The operation of the present invention is quite simple. First, to activate the system, the main switch means 91 is moved to the on position, the selector switch means 85 is set to elect either the foot or hand control units 62, 82, the rheostat means 89 is adjusted to select the desired speed for the drive motor 37, and the fourth switch means 63 is set to select the desired speed of the propelling motor means 17. Then, assuming that the foot control unit 62 was selected by way of the selector switch means 85, the navigator need merely close the third switch member 61 to energize the propelling motor means 79 to cause the boat 15 to be propelled and can "close" either of the first or second switch members 57, 59 to cause the steering means 27 to rotate the propelled motor means 17 in either the first or second direction to provide directional control of the boat 15. On the other hand, assuming that the hand controlled unit 82 was selected by way of the selector switch means 85, the navigator can energize the propelling motor means 17 by closing the seventh switch member 81 and energize the steering means 27 to rotate the propelling motor means 17 in either direction by "closing" either the fifth or sixth switch members 77, 79. It will be noted that the navigator can cause the propelling motor means 17 to continuously rotate in either direction past 360° by merely maintaining one of the switch members 57, 59, 77, 79 in a closed position.

Although the present invention has been described and illustrated with respect to a preferred embodiment and a preferred use therefore, it is not to be so limited since changes and modifications can be made therein which are within the full intended scope of the invention.

I claim:

1. A continuously steerable electric boat motor assembly comprising:

boat mounting means adapted for securement to a boat;

a shaft rotatably coupled to said boat mounting means and extending therebelow;

an electric drive motor means secured to the lower portion of said shaft;

an electric steering motor means fixedly secured with respect to said boat mounting means and coupled to rotatably drive the upper portion of said shaft continuously with respect thereto;

first electric control means electrically connected to selectively provide electrical driving energy to said electric steering motor means to cause continuous clockwise or counter clockwise rotation of said shaft whenever such steering movement is desired;

electrical slip ring and brush means associated with an upper portion of said shaft for continuous rotational coupling of electrical drive energy to said electric drive motor means at the lower portion of said shaft; and second electrical control means electrically connected with a portion of the electrical slip ring and brush means that is fixed relative to said boat mounting means to selectively provide electrical driving energy to said electric drive motor means whenever boat driving forces are desired.

2. A continuously steerable electric boat motor assembly as in claim 1 further comprising:

a housing fixedly secured to said boat mounting means and enclosing said electric steering motor means and said upper portion of the shaft including said electrical slip ring and brush means.

3. A continuously steerable electric boat motor assembly as in claim 1 wherein said electric steering motor means comprises:

a circular gear affixed to said upper portion of said shaft;

an electric steering motor fixedly secured with respect to said boat mounting means and having a rotatable motor shaft; and a worm gear affixed to said rotatable motor shaft and drivingly engaged with said circular gear.

4. A continuously steerable electric boat motor assembly as in claim 3 wherein said first electric control means comprises:

first normally "off" switch means for direct connection between a supply of electrical power and said electric steering motor, all of which is fixed relative to said boat mounting means, said switch means having a first actuated position for causing continuous clockwise rotation of said steering motor and a second actuated position for causing continuous counter clockwise rotation of said steering motor.

5. A continuously steerable electric boat motor assembly as in claim 4 wherein said first electric control means further comprises:

a second one of said switch means electrically connected in parallel with the first-mentioned switch means; and switch selection means for relatively connecting either one of said switches with said steering motor.

6. A continuously steerable electric boat motor assembly as in claim 5 wherein said first electric control means further comprises:

steering speed control means connected between said switch selection means and said steering motor for controlling its rotation speed when either of said first and second switches is in an actuated position.

7. A continuously steering electric boat motor as in claim 4 wherein said second electric control means comprises:

a first further normally "off" switch means associated with said first-mentioned switch means and adapted for connection between an electrical supply and said slip ring and brush means and having an activated position for causing continuous activation of said drive motor means; and a second further normally "off" switch means associated with said second-mentioned switch means and adapted for connection between an electrical supply and said slip ring and brush means and having an actuated position for causing continuous activation of said drive motor means.

8. A continuously steerable electric boat motor assembly as in claim 7 wherein said first electric control means further comprises:

steering speed control means connected between said switch selection means and said steering motor for controlling its rotation speed when either of said first and second switches is in an actuated position.

9. A continuously steerable electric boat motor assembly as in claim 7 wherein said second electric control means further comprises:

drive speed control means connected between said further switch means and said slip ring and brush means for controlling the rotational speed of said drive motor means when said further switch means is in an actuated position.

10. A continuously steerable electric boat motor assembly as in claim 7 wherein:

said first and first-further switch means are configured in a foot-operable arrangement which permits left-right toe movement to select and activate the desired direction of steering movement and which permits heel movements to activate the drive motor; and said second and second-further switch means are configured in a hand-operable arrangement which includes a toggling actuator to select and activate the desired direction of steering movement and which includes a push-button actuator for activating the drive motor.

11. A continuously steerable electric boat motor as in claim 4 wherein said second electric control means comprises:

a further normally "off" switch means for connection between a supply of electrical power and said slip ring and brush means having an activated position for causing continuous activation of said drive motor means.

12. A continuously steerable electric boat motor assembly as in claim 11 wherein said second electric control means further comprises:

drive speed control means connected between said further switch means and said slip ring and brush means for controlling the rotational speed of said drive motor means when said further switch means is in an actuated position.

13. A continuously steerable electric boat motor apparatus comprising:

a boat mount;

a shaft rotatably coupled to said boat mount and having an upper portion extending above the boat mount and a lower portion extending below the boat mount;

a ring gear affixed to said upper portion of the shaft;

a plurality of electrical slip rings also affixed to said upper portion of the shaft;

a drive motor affixed to said lower portion of the shaft and electrically connected to said slip rings;

a steering motor fixedly secured with respect to said boat mount and having a rotationally driven worm gear engaged with said ring gear;

a plurality of electrical brushes fixedly secured with respect to said boat mount, at least one brush being in movable electrical contact with a respectively associated slip ring; and electrical control means electrically connected to said steering motor and to said brushes for controllably activating said steering motor and said driving motor.

14. A continuously steerable electric boat motor apparatus as in claim 13 wherein said electrical control means comprises:

a first plurality of foot-operable switches for selectively activating each of said motors and for controlling the direction of rotation of said steering motor; a second plurality of hand-operable switches for selectively activating each of said motors and for controlling the direction of rotation of said steering motor.

15. A continuously steerable electric boat motor apparatus as in claim 14 wherein said electrical control means further comprises:

switch selection means connected between each of said first and second plurality of switches and said steering motor for permitting only one of said plurality of switches to be effective at a given time to actuate said steering motor.

16. A continuously steerable electric boat motor apparatus as in claim 15 further comprising:

steering speed control means connected between said switch selection means and said steering motor; and drive speed control means connected between said first and second plurality of switches and said brushes for controlling the speed of said drive motor.

* * * * *